US008668087B2

(12) United States Patent
Hargrove et al.

(10) Patent No.: US 8,668,087 B2
(45) Date of Patent: Mar. 11, 2014

(54) TWO-PHASE PACKAGING OF READY MIX JOINT COMPOUND

(75) Inventors: Pamela L. Hargrove, Cary, IL (US); Richard B. Stevens, Village of Lakewood, IL (US)

(73) Assignee: United States Gypsum Company, Chicago, IL (US)

( * ) Notice: Subject to any disclaimer, the term of this patent is extended or adjusted under 35 U.S.C. 154(b) by 196 days.

(21) Appl. No.: 13/335,272

(22) Filed: Dec. 22, 2011

(65) Prior Publication Data

US 2013/0161209 A1 Jun. 27, 2013

(51) Int. Cl.
*B65D 85/84* (2006.01)

(52) U.S. Cl.
USPC ..... 206/447; 206/524.1; 53/474

(58) Field of Classification Search
USPC ..... 206/447, 524.1, 524.4; 53/467, 469, 53/473, 474
See application file for complete search history.

(56) References Cited

U.S. PATENT DOCUMENTS

| | | | | |
|---|---|---|---|---|
| 2,862,616 | A | 12/1958 | Capozzi et al. | |
| 3,819,107 | A | 6/1974 | Ryder, Jr. | |
| 4,228,893 | A | 10/1980 | Franklin et al. | |
| 4,436,204 | A * | 3/1984 | Sowinski | 206/525 |
| 4,454,267 | A | 6/1984 | Williams | |
| 4,525,388 | A | 6/1985 | Rehder et al. | |
| 4,686,253 | A | 8/1987 | Struss et al. | |
| 4,773,556 | A * | 9/1988 | Smith | 220/578 |
| 4,867,312 | A | 9/1989 | Comert et al. | |
| 5,183,152 | A * | 2/1993 | Zak et al. | 206/524.4 |
| 5,323,588 | A * | 6/1994 | Zak et al. | 53/411 |
| 5,336,318 | A | 8/1994 | Attard et al. | |
| 5,746,822 | A | 5/1998 | Espinoza et al. | |
| 6,228,163 | B1 | 5/2001 | Espinoza et al. | |
| 6,295,794 | B1 * | 10/2001 | Nordt et al. | 53/467 |
| 6,354,063 | B1 | 3/2002 | Golownia | |
| 6,406,537 | B1 | 6/2002 | Immordino | |
| 6,476,099 | B1 | 11/2002 | Cimaglio et al. | |
| 6,545,066 | B1 | 4/2003 | Immordino, Jr. et al. | |
| 6,648,164 | B1 | 11/2003 | DeCola et al. | |
| 6,673,144 | B2 | 1/2004 | Immordino, Jr. et al. | |
| 7,543,708 | B2 * | 6/2009 | Doyle et al. | 206/524.8 |
| 2006/0037884 | A1 * | 2/2006 | Doyle et al. | 206/524.8 |
| 2008/0116087 | A1 * | 5/2008 | Hathaway | 206/223 |
| 2008/0210582 | A1 | 9/2008 | Betz et al. | |
| 2009/0301906 | A1 * | 12/2009 | Dalianis | 206/223 |

* cited by examiner

*Primary Examiner* — Jacob K Ackun
(74) *Attorney, Agent, or Firm* — Greer, Burns & Crain, Ltd.; Pradip Sahu; Philip T. Petti

(57) ABSTRACT

A wallboard joint compound package is provided, including a container defining an interior space and configured for being sealed, a first component of ready-mixed joint compound being disposed in the interior space to a level which leaves a pre-determined head space, and an upper surface of the component is defined in the container. A second component is provided, including water, and is placed in the interior space upon the upper surface, such that the first and second components remain substantially distinct prior to opening of the container.

14 Claims, 1 Drawing Sheet

TWO-PHASE PACKAGING OF READY MIX JOINT COMPOUND

FIELD OF THE INVENTION

This invention relates to a ready-mix joint compound. More specifically, it relates to a packaging format for such joint compound which promotes long-term package shelf life as well as more accurate on-site dilution.

BACKGROUND

Walls and ceilings made from gypsum wallboard are conventionally constructed by attaching the wallboard panels to framing members or studs, and filling and coating the joints between the panels with a specially formulated composition called a joint compound. Joint compounds may be powdered compositions designed to be mixed with water at the jobsite or may be premixed with water at the factory to yield a ready mixed (or paste) joint compound. Joint compounds are known in the art, and exemplary compounds are disclosed in commonly assigned U.S. Pat. Nos. 4,454,267; 4,686,253; 5,746,822; 6,228,163; 6,406,537; 6,476,009; 6,545,066 and 6,673,144 all of which are incorporated by reference. A paste joint compound (Taping grade) is placed within and over the joint formed by the abutting edges of the wallboard panels, and a paper reinforcing tape is embedded in the joint with the joint compound which is then permitted to dry. Alternately, the reinforcing tape may be of non-cellulose composition, but of a size and shape similar to strips of paper joint tape. Alternately, the reinforcing tape may be of a fiberglass weave requiring the use of chemically setting type joint compounds. When the joint compound is dry, a second joint compound (Topping or Finishing grade) is applied over the joint, and it too is permitted to dry. It is usually necessary for a third application of a joint compound and, after that third coat is dry, it may be lightly sanded and may be conventionally finished with a decorative material (paint, texture or wallpaper) then applied to the wall. All three coats of joint compound may alternately be done with an All Purpose grade of joint compound.

Ready mixed joint compound is typically supplied to the customer in either cardboard cartons having a plastic liner or plastic pails in units having volumes of 3.5 to 4.5 gallons (13.25-17.03 L). When packaging ready mixed joint compound in pails, often plastic film or coated paper liners are placed over the surface of the joint compound prior to the lid being placed and secured to reduce or delay dry out of the ready mix in the package.

Joint compound is supplied at a viscosity typically higher than what is applied at the jobsite. The higher shipping viscosity is often preferred by the joint compound manufacturer to achieve greater stability of the product in the packaging as it ages on the shelf before it is used at the jobsite. The contractor must find and mix in additional water at the jobsite using a powerful drill and mixing paddle to achieve the desired lower application viscosity. Compound that is too thin, or thinned to typical jobsite use viscosities when produced at the factory, can have problems with settling and syneresis (liquid separation). Typical shipping viscosities for joint compounds range from 400 to 800 Brabender Units (BU), while jobsite viscosities typically range from 180 to 380 BU.

Thinning of the joint compound at the jobsite usually involves addition of water through measuring methods that are inaccurate or variable. Examples of such water addition methods include two shakes of a water soaked bucket cleaning brush, various sized soft drink or coffee cups, or scoops of water from buckets using the corner of a mud pan. Even with care, these methods result in differing amounts of water added into the ready mixed joint compound and differing viscosities of the thinned compound. Obtaining water at a jobsite is often a difficulty, as on some jobsites the water supply has not yet been connected, or has been compromised by contamination from dirt and particles.

The head space between the top surface of the packaged compound and the top of the container often does not allow enough room for the addition of sufficient water needed to reduce the viscosity of the ready mixed joint compound to the desired consistency. Since the contractor usually desires to use the joint compound at a lower viscosity than that provided in the package, a conventional practice is to remove a portion of the joint compound from the package prior to the addition of water to the package, for subsequent mixing to the desired viscosity, depending on the application.

One disadvantage of this practice is that the joint compound removed must be temporarily stored for later use, or is discarded. Thus, either the contractor must have extra empty containers available for storing the unused compound, or the compound is wasted. Another disadvantage of this practice is that, as described above, the viscosity of the resulting joint compound will vary based on the amount of water added or the amount of joint compound removed, potentially resulting in inconsistent performance results.

Providing the joint compound at a ready-to-use lower viscosity, or relatively diluted state is considered undesirable due to the greater chances for phase separation over the shipping and storage period. When such relatively diluted materials generate phase separation or sedimentation, even aggressive mixing is often inadequate to restore desired uniform distribution of joint compound constituents for proper function.

The higher than desired viscosity affects the ease of pumping and moving the material out of the mixing system and through the packaging line. Thus, there are mechanical limitations on the types of raw materials that can be used within a typical wet mixing system for manufacturing ready mix.

SUMMARY

The above-identified drawbacks of the prior art are addressed by a joint compound packaging system in which the difficulties of accurately adding the proper amount of water to thin down a ready mixed joint compound at the jobsite are overcome. A further object of the invention is to eliminate the need to find clean water at a jobsite for the purposes of thinning down a ready mixed joint prior to use. The inventive system also allows the manufacturer of the ready mixed joint compound to package the ready mixed joint compound paste at a higher viscosity into its packaging to avoid stability issues and to eliminate the plastic film or coated paper liners across the surface as the water acts as a barrier preventing dry out of the ready mix in the closed pail during extended storage. Manufacturing of ready mixed joint compounds of the inventive system is the same as for standard production of ready mixed joint compounds, except at the time the packaging containers are filled. While the examples are provided describing the present packaging system used with plastic pails, it is contemplated that the present system is usable with other types of containers, including but not limited to cardboard cartons enclosing sealed plastic liners.

A wallboard joint compound is provided that includes a base joint compound including a homogeneous, paste-like blend of water and at least one of a filler, a binder, a thickener, a suspending agent, a biocide, a preservative, a mineral filler and expanded perlite packaged into a container as well as water added as a second component not blended in with the rest of the ready mixed paste within the container. Whereas in standard production, the ready mixed joint compound paste is added to the container and then the container is closed, the inventive system adds a step in the filling process where an amount of water is added on top of the layer of ready mixed joint compound paste before the container is closed. With water laid on top of the ready mixed joint compound paste within the packaging, the water constitutes one phase, while the thick paste-like joint compound forms another phase, both within the same packaging. The amount of water to be added within the packaging as a top layer or phase is determined by measuring the viscosity of the ready mixed joint compound paste before the thin-down water is added, and the correct amount of water is added such that after drill mixing and blending the two phases together will result in the now thinned down joint compound being at a desired low viscosity value (<400 BU) arranged to suit the preferences of the customers. The viscosity of the ready mixed joint compound phase is set at a level where a high viscosity for the paste (>400 BU) can be maintained and avoid the problems associated with a low shipping viscosity (<400 BU).

It is clear then that manufacturing ready mixed joint compounds in accordance with this disclosure enables the user of the joint compound to be able to consistently obtain the same thinned down viscosity for any of the packages of joint compound that are opened. Applicators will benefit from the improvement in uniformity for the joint compound used at the jobsite, instead of the current variable performance due to inaccuracies in the water addition methods for thinning joint compounds. The product of the present system is ready to use at the correct viscosity after the remixing process. Use of the present system also frees the user from needing to find a source of clean water for thinning. It no longer matters if water is available at the jobsite, because the water is contained within the packaging. The required amount of dilution water has already been provided in the container and so conventional compromises to the quality of the joint compound by using dirty or contaminated water are avoided.

More specifically, a wallboard joint compound package is provided, including a container defining an interior space and configured for being sealed, a first component of ready-mixed joint compound being disposed in the interior space to a level which leaves a pre-determined head space, and an upper surface of the component is defined in the container. A second component is provided, including water, and is placed in the interior space upon the upper surface, such that the first and second components remain substantially distinct prior to opening of the container.

In another embodiment, a wallboard joint compound package is provided, including a container defining an interior space and configured for being sealed with a lid, a first component of ready-mixed joint compound being dispensed in the interior space to a level which leaves a pre-determined head space adequate in size for accommodating a second component being a blend of water and a preserving agent dispensed on an upper surface of the first component ready mixed joint compound. In the preferred embodiment, the first component is a paste-like blend of water and at least one of a filler; a binder, a thickener, a suspending agent, a biocide, a preservative, a mineral filler and expanded perlite. The second component is placed in the interior space upon the upper surface. The preserving agent of the second component is taken from the group consisting of a bacteristat, bleach and a disinfectant, the first and second components remain substantially distinct prior to opening of the container.

DETAILED DESCRIPTION

Figure 1:
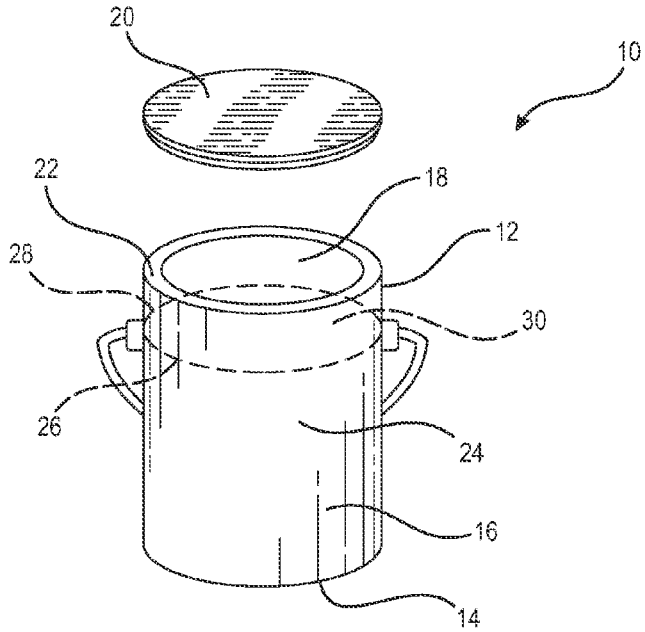
FIG. 1 is a top perspective, partially exploded view of the present joint compound package including a container filled with relatively high viscosity ready-mix joint compound.
Figure 2:
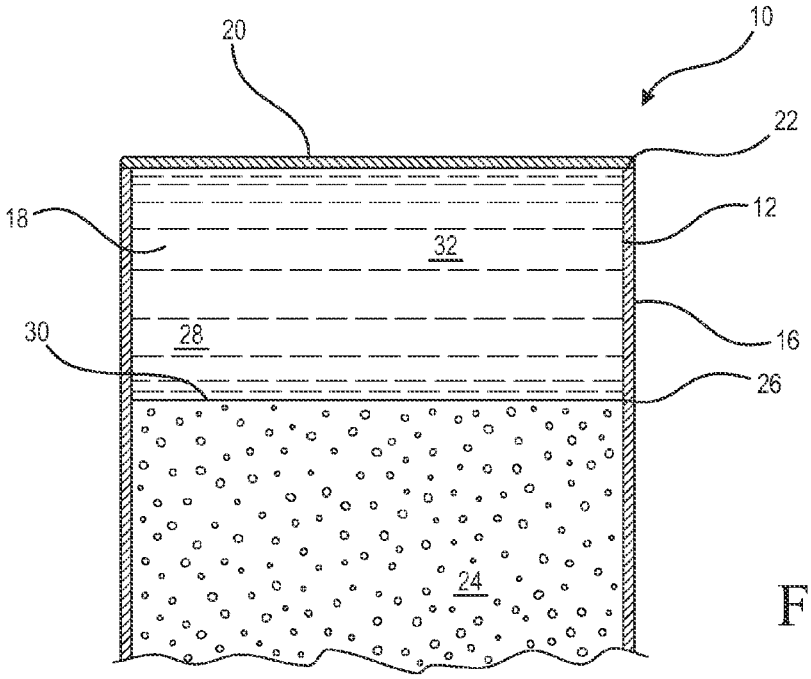
FIG. 2 is a fragmentary vertical section of the present package showing the joint compound component and the water/preservative blend component.

Referring now to FIGS. 1 and 2, the present wallboard joint compound package is generally designated 10 and includes a container 12, which in the preferred embodiment is a rigid plastic or metal pail of 1 to 5 gallons, however other types and materials of such containers are contemplated, and are widely known in the art of joint compounds. One alternate container 12 is a cardboard carton provided with a sealing plastic liner. Included in the container 12 is a bottom 14 and a peripheral wall 16 preferably integrally formed with each other, and which together define an interior space 18. When the packaging is a pail, a lid 20 is conventionally provided for sealing the interior space, also as is known in the art. The lid 20 is secured to an upper edge 22 of the peripheral wall 16.

Poured into the interior space 18 is a pre-specified volume of relatively high viscosity, ready-mix joint compound 24. Such compounds are known in the art, and examples of which are described in commonly-assigned U.S. Pat. Nos. 6,545,066; 6,228,163; and 5,746,822 which are incorporated by reference herein. It is contemplated that the specific composition of the ready-mix joint compound 24 may vary to suit the particular application. The joint compound 24 has a density of approximately 13 lbs./gal. (1.55 kg/l) and is referred to as the first component of the package 10.

Preparation of an exemplary joint compound 24 incorporates a filler, a binder, a thickener, preservatives, a non-leveling agent and water as commonly understood by those well in the art. Lightweight filler may be optionally included into the base skilled compound to adjust the density of the composition. While information about the ingredients used in the ready mixed joint compound 24 are herein provided, it is understood that the present system for could be used and found useful for any joint compound of any composition that is typically thinned for use at a jobsite. While joint compounds typically fall into this category of thin before use materials, the inventive system can also be considered for other ready mixed materials that are not joint compounds.

Filler for use in the base compound may be any of the calcium carbonate or calcium sulfate dehydrate fillers common to preparation of typical joint compounds and known to those skilled in the art. Fillers ground to median particle size between 5 and 40 microns are typically used. Usage levels are typically between 50% to 95% by weight of the total composition ingredients not including the water added (a dried component basis), although examples of filler-free compounds do exist.

A latex emulsion binder is an important ingredient which is well known to those skilled in the joint compound art and may comprise some or all of the binder of the invention. Any of the conventional latex binders may be used, with polyvinyl acetate and ethylene vinyl acetate emulsions being preferred. If present, the latex binder ranges from about 0.5% to about 10% by weight of the composition prior to adding water, with some embodiments using 1% to about 8% (on a dried component basis). The use of spray-dried binders is contemplated with usages ranging from 0.1% to 1.5% (on a dried component basis).

It is generally preferred that the joint compound 24 include one or more thickeners. Conventional cellulosic thickeners, e.g. ethylhydroxy ethylcellulose, hydroxypropyl methylcellulose, methylhydroxypropyl cellulose, hydroxyethyl cellulose, methylhydroxyethyl cellulose and mixtures thereof, may be used in the joint compounds of this invention. The total amount of cellulosic thickener ranges from about 0.1% to about 3%, preferably 0.3 to 1% by weight of the total composition ingredients not including the water added. It is contemplated that other thickeners will be used instead of or in addition to the cellulosic thickener.

The joint compound 24 may also contain a non-leveling agent or suspending agent such as attapulgus clay. This ingredient provides non-leveling or anti-sag, slip, water retention, and water demand. In general, the amount of the non-leveling agent, if present, ranges from about 1% to about 10%, preferably 2% to 7% by weight of the base composition prior to adding water. Other clays such as sepiolite, bentonite and montmorillonite may also be used in the joint compound base, in addition to or instead of the clay. Non-clay non-leveling or suspending agents such as the types listed in U.S. Pat. No. 5,336,318, incorporated by reference, are of use in the present joint compound.

When preparing the ready-mix joint compound 24, it is preferred to provide for control of microbial growth in the wet medium during storage. One method of reducing microbes is by introducing a biocide that kills on contact. Examples of contact-kill biocides include household bleach (6% aqueous sodium hypochlorite) or chemicals for shock treatment of swimming pools, such as lithium or calcium hypochlorite. Although these additives will kill a substantial amount of the microbes present in the joint compound base at the time of manufacture, they will not prevent future microbial growth.

Conventional in-can preservatives, including MERGAL 174 liquid bactericide made by Troy Corporation, Florham Park, N.J. and/or Nuosept 91 liquid organic biocide is available from International Specialty Products, Wayne, N.J., are used for continuing suppression of microbial growth. They can be used in combination with or in place of the contact-kill treatments. Combinations of preservatives or contact kill biocides are also contemplated in the dilution water to add an additional level of microbial resistance to the ready mixed joint compound.

Water is added in amounts selected to produce the joint compound 24 of a desired viscosity. A high viscosity base joint compound a viscosity of 400-800 BU is preferred to yield the performance benefits of a thicker material. Viscosity is measured with a pin type probe (Brabender Type A) and 250 cmg torque head using a Brabender Viscocorder, or alternately use of a Brookfield R/S plus Rheometer.

The joint compound 24 is optionally a lightweight, ready-mixed type joint compound, and the lightweight or low density property can be provided by incorporating an expanded perlite into the joint compound base in accordance with the disclosure in U.S. Pat. No. 4,454,267, incorporated by reference. It is well known in the art that it is preferred that the expanded perlite should have a particle size which will pass through a 100 mesh screen if it is to be incorporated into a joint compound base. In the ready-mixed joint compound 24, the expanded perlite is optionally treated to render it water-insensitive or left uncoated. If it is advantageous to treat the expanded perlite, there are several ways to render the expanded perlite water-insensitive, one of which is disclosed in U.S. Pat. No. 4,525,388, incorporated by reference. Another method is to treat the expanded perlite with a silicone or siloxane compound, but other materials may be used to render it water-insensitive (i.e., water-repellent). Specially treated expanded perlite is commercially available from suppliers such as Silbrico Corporation, Hodgkins, Ill.

To achieve the desired lightweight properties, the expanded perlite should be present in amounts of at least about 1% by weight of all of the ingredients in the compound, excluding the water. It is particularly preferred that the expanded perlite be present in amounts between about 5% and about 10% by weight of all of the ingredients in the joint compound 24, excluding the water.

Conventional ready-mixed joint compounds frequently contain mineral fillers, such as diatomaceous earth, mica, talc, or sericite to provide reduced cracking and shrinkage, and added slip. When used in the present joint compound 24, the mica or talc may be between about 2% and about 15% by weight of the composition excluding water.

Additional ingredients frequently used in joint compounds are contemplated for use in the present joint compound 24. These ingredients optionally include, but are not limited to humectants, fillers, wetting agents, kaolin, defoamers and plasticizers which are also useful in the joint compound 24.

The joint compound base was made by weighing the dry components and combining them in a vessel. Water was weighed and placed into a second vessel. The remaining wet ingredients were also weighed and added to the water, the wet ingredients including the latex emulsion and preservatives. The combined ingredients were mixed until smooth. Following completion of the blending and mixing the compound was dispensed into containers, but not yet closed. To determine the correct amount of water to add into the package to serve as the thin-down water, the viscosity of the ready mixed joint compound phase was first determined, and by prior correlation the correct amount of water was then added on top of the layer of joint compound so that when the two phases were blended, the desired lower end use viscosity (180-380 BU) would result. It is understood that the selection of a desired lower end use viscosity would vary by product type and geography dependent on the rheology and performance desired by the customer. As described above, the relative percentages of the first, joint compound component and the second, dilution water component may vary with the desired resulting viscosity or performance characteristics, in the examples described below, the first component comprised approximately 97-98% by weight or volume of the ingredients in the package 10, and the second component comprised approximately 2-3% by weight or volume.

Referring again to FIGS. 1 and 2, the first component, or the ready-mixed joint compound 24 is disposed in the interior space 18 to a level 26 in the container 12 which leaves a pre-determined head space 28, which is an upper portion of the interior space. An upper surface 30 of the first component is defined in the container 12 once the joint compound is poured into the container. In the preferred embodiment, the level 26 can be any amount of the joint compound 24 being filled to a desired level 26 or fill height of the interior space 18 as long as there is sufficient headspace for the addition of the second phase of predetermined dilution water. The fill height 26 is a function of the viscosity of the ready mixed first component 24, the desired viscosity of the blended components, the amount of ready mixed joint compound chosen, the amount of dilution water phase, and the chosen size of the container 12. It can be readily seen that additional headspace can be obtained by choosing a larger or taller container, or if the desire is to offer the same sized container 12 that a smaller amount of the first component 24 or ready mixed joint compound would be required.

A second component 32 (FIG. 2) of the present package 10 is a blend of water and an optional preserving agent, and is placed in the interior space 18 upon the upper surface 30, such that the first and second components 24, 32 remain substantially distinct prior to opening of the container 12. The preserving agent is preferably taken from the group consisting of a bacteristat, bleach and a disinfectant. The specific percentages of the preserving agent in the water may vary to suit the situation.

Another advantage of the present second component 32 relates to a problem occurring once the lid 20 is sealed. Air still has the tendency to leak into the interior space 18 potentially, causing a crusting of the upper surface 30. However, the second component 32 acts as a barrier layer to prevent exposure of the upper surface 30 to air.

Example 1

Two Phase Ready Mixed Joint Compound: Proportions of Ready Mixed Joint Compound Phase and Water Phase Example 1

TABLE 1

| | SHEETROCK ™ brand All Purpose Joint Compound, Ready Mixed | SHEETROCK ™ brand Lightweight All Purpose Joint Compound, Ready Mixed |
|---|---|---|
| Nominal Packaging Size & Type | 4.5 gallon plastic pail | 4.5 gallon plastic pail |
| Net Weight of Joint Compound Phase in Container | 61.7 pounds | 43.6 pounds |
| Initial In-Can Viscosity of the Joint Compound Phase in Container | 500 BU | 497 BU |
| Amount of Separate Water Phase in Container | 598 grams | 647 grams |
| Viscosity of Mixture after Blending Joint Compound Phase and Thin-down Water Phase | 350 BU | 278 BU |

The above example clearly shows the amounts and proportions of both the ready mixed joint compound paste phase and the dilution water phase that would be contained within typically sized packaging for joint compounds. Knowing the viscosity of the ready mixed paste, an amount of water is added to the container that resulted in a blended joint compound mixture of desired application viscosity. While the materials in Example 1 show a normal weight of ready mixed joint compound paste contained within that container and the dilution water as an additional weight within the package, it is contemplated that the weight of the ready mixed joint compound phase and dilution water phase can be reduced so that the weight total for the ready mixed joint compound phase plus the added dilution water phase is at the appropriate normal package weight. In this way the manufacturer would reduce cost as an additional benefit of the inventive system.

Thus, it will be seen that joint compound is provided with enhanced performance through a novel packaging approach for including the correct amount of dilution water optionally containing added biocide or preservative on top of the ready mixed joint compound paste inside the packaging before the package is closed, so that when the package is opened and the two phases are blended, the resultant joint compound will be at the proper viscosity for use by the applicator at the jobsite. More specifically, a joint compound package is provided including a container filled to a pre-specified level by a relatively high viscosity ready mix joint compound. Above the joint compound, a sufficient head space is provided for receiving an amount of a blend of water and a preservative. The amount of water is determined by the desired resulting viscosity, and the volume of joint compound in the container. During shipping and storage, the joint compound and the water blend do not appreciably mix. In addition to providing the appropriate amount of water blend for the desired dilution, the water blend serves as a barrier layer that prevents exposure of the upper surface of the joint compound to air, and thus preventing crusting of the upper layer.

While a particular embodiment of the two phase packaging of ready mixed joint compound has been shown and described, it will be appreciated by those skilled in the art that changes and modifications may be made thereto without departing from the invention in its broader aspects.

We claim:

1. A wallboard joint compound package, comprising:

a container defining an interior space and configured for being sealed;

a first component of homogeneous ready-mixed joint compound being disposed in said interior space to a level which leaves a pre-determined head space, and an upper surface of said component is defined in said container; and a second component including water is placed in said interior space upon said upper surface, such that said first and second components remain substantially distinct prior to opening of said container.

2. The package of claim 1 wherein said second component is a blend of water and a preserving agent.

3. The package of claim 2 wherein said preserving agent is taken from the group consisting of a bacteristat, bleach and a disinfectant.

4. The package of claim 1 wherein said ready-mix joint compound is a paste-like blend of water and at least one of a filler; a binder, a thickener, a suspending agent, a biocide, a preservative, a mineral filler and expanded perlite.

5. The package of claim 4 wherein said filler is at least one of calcium carbonate or calcium sulfate dehydrate, comprising approximately 50-95% of the dry weight of the composition.

6. The package of claim 4, wherein said binder is a latex emulsion binder comprising approximately 0.5-10% of the dry weight of the composition.

7. The package of claim 4, wherein said thickener is a cellulosic thickener comprising 0.1 to 3.0% of the dry weight of the composition.

8. The package of claim 4, wherein said suspending agent comprises 1.0 to 10% of the dry weight of the composition.

9. The package of claim 4, wherein said expanded perlite comprises 1.0 to 10% of the dry weight of the composition.

10. The package of claim 1, wherein said second component acts as a barrier layer to prevent exposure of said upper surface to air.

11. The package of claim 1, further including a lid for sealing said container.

12. A wallboard joint compound package, comprising:

a container defining an interior space and configured for being sealed with a lid;

a first component of ready-mixed joint compound being dispensed in said interior space to a level which leaves a pre-determined head space, and an upper surface of said component is defined in said container, said first component is a paste-like blend of water and at least one of a filler; a binder, a thickener, a suspending agent, a biocide, a preservative, a mineral filler and expanded perlite; and a second component of a blend of water and a preserving agent is placed in said interior space upon said upper surface, said preserving agent is taken from the group consisting of a bacteristat and a disinfectant, said first and second components remain substantially distinct prior to opening of said container.

13. A method of preparing a joint compound package, comprising:

providing a joint compound container;

preparing a ready mixed joint compound;

adding the joint compound to the container such that a head space is defined between an upper surface of the joint compound and an upper edge of the container;

adding an amount of water on top of the upper surface of the ready mixed joint compound; and closing the container.

14. The method of claim 13, further including determining the amount of water to be added within the container as a top layer or phase by measuring the viscosity of the ready mixed joint compound paste before the water is added, and the correct amount of water is added such that after drill mixing and blending the two phases together will result in a thinned down joint compound being at a desired low viscosity value in the range of less than 400 BU.

* * * * *